US009371150B2

(12) United States Patent
Wnek

(10) Patent No.: US 9,371,150 B2
(45) Date of Patent: Jun. 21, 2016

(54) CONTAINER WITH SCORE LINES

(71) Applicant: Graphic Packaging International, Inc., Atlanta, GA (US)

(72) Inventor: Patrick H. Wnek, Sherwood, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 85 days.

(21) Appl. No.: 14/055,127

(22) Filed: Oct. 16, 2013

(65) Prior Publication Data

US 2014/0103038 A1 Apr. 17, 2014

Related U.S. Application Data

(60) Provisional application No. 61/795,501, filed on Oct. 17, 2012, provisional application No. 61/795,852, filed on Oct. 29, 2012.

(51) Int. Cl.

| | |
|---|---|
| ***B65D 3/22*** | (2006.01) |
| ***B65D 3/28*** | (2006.01) |
| ***B65D 1/34*** | (2006.01) |
| ***B65D 1/42*** | (2006.01) |
| ***B65D 1/28*** | (2006.01) |

(52) U.S. Cl.

CPC .. *B65D 3/22* (2013.01); *B65D 1/28* (2013.01); *B65D 1/34* (2013.01); *B65D 1/42* (2013.01); *B65D 3/28* (2013.01)

(58) Field of Classification Search

CPC ..... B65D 3/22; B65D 3/28

USPC ..... 229/406, 407; 220/62.2, 574

See application file for complete search history.

(56) References Cited

U.S. PATENT DOCUMENTS

| | | | |
|---|---|---|---|
| 1,022,882 | A | 4/1912 | Schwenn |
| 1,986,824 | A | 1/1935 | Keiding |
| 2,387,778 | A | 10/1945 | Stocking |
| 2,522,397 | A | 9/1950 | Palmer |
| 2,634,880 | A | 4/1953 | Gravatt |
| 2,831,623 | A | 4/1958 | Lavigne |
| 2,997,927 | A | 8/1961 | Carson |
| 3,033,434 | A | 5/1962 | Carson |

(Continued)

FOREIGN PATENT DOCUMENTS

| | | |
|---|---|---|
| CH | 509 065 | 4/1969 |
| DE | 80 11 020 | 9/1980 |

(Continued)

OTHER PUBLICATIONS

International Search Report and Written Opinion for PCT/US2013/065198 dated Jan. 13, 2014.

(Continued)

*Primary Examiner* — Gary Elkins

(74) *Attorney, Agent, or Firm* — Womble Carlyle Sandridge & Rice, LLP

(57) ABSTRACT

A container for holding an article. The container comprises a lamination layer at least partially secured to a base layer, a bottom wall, and a side wall. The bottom wall and the side wall cooperate to at least partially define a cavity of the container with the lamination layer at least partially comprising an interior surface of the container adjacent the cavity. A plurality of score lines extend in the container for at least partially reducing buckling of the lamination layer into the cavity of the container.

31 Claims, 9 Drawing Sheets

(56) References Cited

U.S. PATENT DOCUMENTS

| | | | | |
|---|---|---|---|---|
| 3,099,377 | A | 7/1963 | Metzler et al. | |
| 3,195,770 | A | 7/1965 | Robertson | |
| 3,220,631 | A | 11/1965 | Reifers | |
| 3,229,886 | A | 1/1966 | Grogel | |
| 3,286,876 | A | 11/1966 | Ring | |
| 3,315,018 | A | 4/1967 | Commeyras | |
| 3,530,917 | A | 9/1970 | Donavan | |
| 3,669,305 | A | 6/1972 | Kinney et al. | |
| 3,680,733 | A | 8/1972 | Winslow | |
| 3,684,633 | A | 8/1972 | Haase | |
| 3,836,042 | A | 9/1974 | Petitto | |
| 3,850,340 | A | 11/1974 | Siemonsen et al. | |
| 3,968,921 | A | 7/1976 | Jewell | |
| 4,026,458 | A | 5/1977 | Morris et al. | |
| 4,051,707 | A | 10/1977 | Valek et al. | |
| 4,096,947 | A | 6/1978 | Morse | |
| 4,111,303 | A | 9/1978 | Compton | |
| 4,139,115 | A | 2/1979 | Robinson | |
| 4,183,435 | A | 1/1980 | Thompson et al. | |
| 4,202,464 | A | 5/1980 | Mohs et al. | |
| 4,284,023 | A | 8/1981 | Murayama | |
| 4,381,278 | A * | 4/1983 | Ingraffea | 264/512 |
| 4,420,081 | A | 12/1983 | Dart | |
| 4,606,496 | A | 8/1986 | Marx et al. | |
| 4,609,140 | A | 9/1986 | Van Handel et al. | |
| 4,704,510 | A | 11/1987 | Matsui | |
| 4,721,499 | A | 1/1988 | Marx et al. | |
| 4,721,500 | A | 1/1988 | Van Handel et al. | |
| 4,775,771 | A | 10/1988 | Pawlowski et al. | |
| 4,832,202 | A | 5/1989 | Newman et al. | |
| 4,832,676 | A | 5/1989 | Johns et al. | |
| 4,865,921 | A | 9/1989 | Hollenberg et al. | |
| 4,890,439 | A | 1/1990 | Smart | |
| 4,900,594 | A * | 2/1990 | Quick et al. | 428/34.2 |
| 4,935,089 | A | 6/1990 | Schirmer | |
| 4,936,935 | A | 6/1990 | Beckett | |
| 4,963,424 | A | 10/1990 | Beckett | |
| 4,967,908 | A | 11/1990 | Kessler | |
| 5,039,364 | A | 8/1991 | Beckett et al. | |
| 5,105,947 | A | 4/1992 | Wise | |
| 5,117,078 | A | 5/1992 | Beckett | |
| 5,176,284 | A | 1/1993 | Sorensen | |
| 5,190,209 | A | 3/1993 | Gordon et al. | |
| 5,203,491 | A * | 4/1993 | Marx et al. | 229/407 |
| 5,213,902 | A | 5/1993 | Beckett | |
| 5,221,419 | A | 6/1993 | Beckett | |
| 5,230,939 | A * | 7/1993 | Baum | 428/84 |
| 5,260,537 | A | 11/1993 | Beckett | |
| 5,266,386 | A | 11/1993 | Beckett | |
| 5,269,717 | A | 12/1993 | Tardif | |
| RE34,683 | E | 8/1994 | Maynard et al. | |
| 5,340,436 | A | 8/1994 | Beckett | |
| 5,354,973 | A | 10/1994 | Beckett | |
| 5,410,135 | A | 4/1995 | Pollart et al. | |
| 5,424,517 | A | 6/1995 | Habeger, Jr. et al. | |
| 5,519,195 | A | 5/1996 | Keefer et al. | |
| 5,595,802 | A | 1/1997 | Weder et al. | |
| 5,617,972 | A | 4/1997 | Morano et al. | |
| 5,628,921 | A | 5/1997 | Beckett | |
| 5,672,407 | A | 9/1997 | Beckett | |
| 5,721,022 | A | 2/1998 | Morita et al. | |
| 5,758,773 | A | 6/1998 | Clements | |
| 5,759,422 | A | 6/1998 | Schmelzer et al. | |
| 5,782,376 | A | 7/1998 | Brauner et al. | |
| 5,800,724 | A | 9/1998 | Habeger et al. | |
| 5,934,472 | A | 8/1999 | Ramirez et al. | |
| 5,938,112 | A | 8/1999 | Sandstrom | |
| 6,093,460 | A | 7/2000 | Iwaya | |
| 6,114,679 | A | 9/2000 | Lai et al. | |
| 6,150,646 | A | 11/2000 | Lai et al. | |
| 6,204,492 | B1 | 3/2001 | Zeng et al. | |
| 6,213,301 | B1 | 4/2001 | Landis et al. | |
| 6,251,451 | B1 | 6/2001 | Zeng | |
| 6,270,003 | B1 | 8/2001 | Hirano | |
| 6,325,213 | B1 | 12/2001 | Landis, II | |
| 6,414,290 | B1 | 7/2002 | Cole et al. | |
| 6,415,945 | B1 | 7/2002 | Zank et al. | |
| 6,427,381 | B1 | 8/2002 | Weder | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,568,534 | B2 | 5/2003 | Zank | |
| 6,677,563 | B2 | 1/2004 | Lai | |
| 6,717,121 | B2 | 4/2004 | Zeng et al. | |
| 6,718,788 | B1 | 4/2004 | Shuck | |
| 6,765,182 | B2 | 7/2004 | Cole et al. | |
| 6,988,654 | B2 | 1/2006 | Wnek | |
| 7,048,176 | B2 | 5/2006 | Littlejohn et al. | |
| 7,337,943 | B2 | 3/2008 | Johns et al. | |
| 7,552,840 | B2 | 6/2009 | Gitschlag et al. | |
| 7,975,871 | B2 | 7/2011 | Wnek et al. | |
| 8,464,871 | B2 | 6/2013 | Wnek | |
| 8,474,689 | B2 * | 7/2013 | Littlejohn et al. | 229/407 |
| 8,534,460 | B2 | 9/2013 | Wnek et al. | |
| 2002/0092791 | A1 | 7/2002 | Wnek | |
| 2002/0113118 | A1 | 8/2002 | Littlejohn et al. | |
| 2002/0179612 | A1 * | 12/2002 | Toussant | 220/574 |
| 2003/0205319 | A1 | 11/2003 | Bengtsson et al. | |
| 2004/0262322 | A1 | 12/2004 | Middleton et al. | |
| 2005/0109653 | A1 | 5/2005 | Wnek et al. | |
| 2006/0198972 | A1 | 9/2006 | Ueda et al. | |
| 2007/0081743 | A1 | 4/2007 | Kim | |
| 2007/0235514 | A1 * | 10/2007 | Abayhan et al. | 229/407 |
| 2007/0267374 | A1 | 11/2007 | Middleton et al. | |
| 2009/0152333 | A1 | 6/2009 | Maeaettae | |
| 2009/0173776 | A1 | 7/2009 | Swoboda et al. | |
| 2009/0223952 | A1 | 9/2009 | Wnek et al. | |
| 2011/0048999 | A1 | 3/2011 | Wnek | |

FOREIGN PATENT DOCUMENTS

| | | | |
|---|---|---|---|
| DE | 87 13 290.7 | | 1/1988 |
| DE | 37 37 052 | | 5/1989 |
| DE | 296 02 348 | | 5/1996 |
| DE | 101 49 143 | | 4/2003 |
| EP | 0 082 209 | | 6/1983 |
| EP | 1 332 972 | | 8/2003 |
| EP | 1 604 903 | A2 | 12/2005 |
| EP | 1 818 265 | A2 | 8/2007 |
| EP | 2 388 201 | A1 | 11/2011 |
| FR | 2 266 638 | | 10/1975 |
| FR | 2 599 002 | | 11/1987 |
| FR | 2 733 715 | | 11/1996 |
| GB | 609142 | | 9/1948 |
| GB | 961204 | | 6/1964 |
| GB | 1 264 484 | | 2/1972 |
| GB | 1 348 370 | | 3/1974 |
| GB | 1 376 603 | | 12/1974 |
| GB | 2 061 699 | | 5/1981 |
| GB | 2 171 048 | | 8/1986 |
| JP | 47-23456 | | 10/1972 |
| JP | 54-116059 | | 9/1979 |
| JP | 54-126887 | | 10/1979 |
| JP | 56065866 | | 6/1981 |
| JP | 59-75004 | | 4/1984 |
| JP | 3-4582 | | 1/1991 |
| JP | 3057020 | | 5/1991 |
| JP | 6000843 | | 1/1994 |
| JP | 60-96234 | | 4/1994 |
| JP | 07-028883 | | 1/1995 |
| JP | 08-156944 | | 6/1996 |
| JP | 3031361 | | 9/1996 |
| JP | 8-337234 | | 12/1996 |
| JP | 08-337235 | | 12/1996 |
| JP | 09-254948 | | 9/1997 |
| JP | 2000-043840 | | 2/2000 |
| JP | 2000-142825 | | 5/2000 |
| JP | 2000-238760 | | 9/2000 |
| JP | 2000-335550 | | 12/2000 |
| JP | 2000-517260 | | 12/2000 |
| JP | 2001-213420 | | 8/2001 |
| JP | 2001-328617 | | 11/2001 |
| JP | 2003-312631 | A | 11/2003 |
| WO | WO 96/11142 | | 4/1996 |

(56) References Cited

FOREIGN PATENT DOCUMENTS

| | | |
|---|---|---|
| WO | WO 98/09812 | 3/1998 |
| WO | WO 03/066435 | 8/2003 |
| WO | WO 03/078012 | 9/2003 |
| WO | WO 2004/033324 | 4/2004 |
| WO | WO 2008/049048 | 4/2008 |
| WO | WO 2009/086501 | 7/2009 |
| WO | WO 2009/088904 | 7/2009 |

OTHER PUBLICATIONS

Supplementary European Search Report for EP 13 84 7792 dated Apr. 20, 2016.

* cited by examiner

CONTAINER WITH SCORE LINES

CROSS-REFERENCE TO RELATED APPLICATION

This application claims the benefit of U.S. Provisional Patent Application No. 61/795,501, filed Oct. 17, 2012, and U.S. Provisional Patent Application No. 61/795,852, filed Oct. 29, 2012.

INCORPORATION BY REFERENCE

The disclosures of U.S. Provisional Patent Application No. 61/795,501, which was filed Oct. 17, 2012, and U.S. Provisional Patent Application No. 61/795,852, which was filed Oct. 29, 2012, are hereby incorporated by reference as if presented herein in their entirety.

BACKGROUND OF THE DISCLOSURE

The present disclosure relates to blanks, containers, trays, constructs, and various features to facilitate forming a container from a blank.

SUMMARY OF THE DISCLOSURE

In one aspect, the disclosure is generally directed to a container for holding an article. The container comprises a lamination layer at least partially secured to a base layer, a bottom wall, and a side wall. The bottom wall and the side wall cooperate to at least partially define a cavity of the container with the lamination layer at least partially comprising an interior surface of the container adjacent the cavity. A plurality of score lines extend in the container for at least partially reducing buckling of the lamination layer into the cavity of the container.

In another aspect, the disclosure is generally directed to a blank for forming a container for holding an article. The blank comprises a lamination layer at least partially secured to a base layer, a bottom portion, and a marginal portion. The bottom portion and the marginal portion are for cooperating to at least partially define a cavity of the container formed from the blank. The lamination layer is for at least partially forming an interior surface of the container formed from the blank. A plurality of score lines extend in the blank for at least partially reducing buckling of the lamination layer into the cavity of the container formed from the blank.

In another aspect, the disclosure is generally directed to a method of forming a container. The method comprises obtaining a blank comprising a lamination layer at least partially secured to a base layer and a plurality of score lines. The method further comprises forming the container comprising a bottom wall and a side wall from the blank. The forming the container comprises forming a cavity at least partially defined by the bottom wall and the side wall. The lamination layer comprises an interior surface of the container adjacent the cavity. During the forming the container, the plurality of score lines at least partially reduces buckling of the lamination layer into the cavity of the container.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale.

Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figures 1, 1A, 1B:
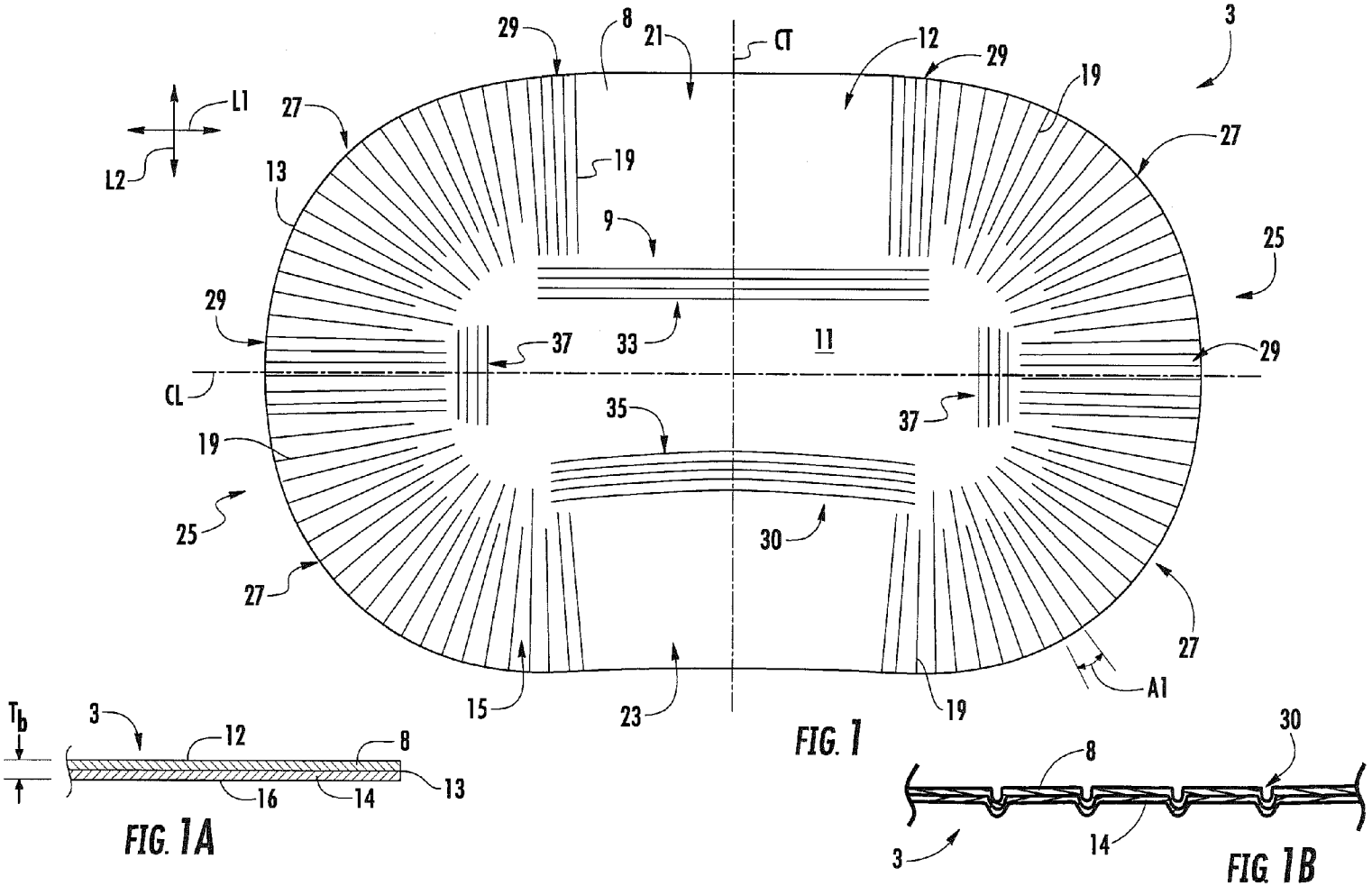
FIG. 1 is a plan view of a blank used for forming a container according to a first embodiment of the disclosure.
FIG. 1A is a partial cross-sectional view of a marginal portion of the blank of FIG. 1.
FIG. 1B is a partial cross-sectional view of a bottom corner area of the blank of FIG. 1.

FIG. 1 illustrates a blank 3 that is used to form a container 5 (FIGS. 2-4) having a flange 7 according to a first embodiment of the disclosure. In the illustrated embodiment, the blank 3 has generally straight side edges and semicircular or arc-shaped end edges. The blank 3 is for being press formed into the container 5 that, in the illustrated embodiment, is a tray with a generally straight side, a concave side, and convex ends. It is understood that the blank 3 can be press-formed into the container 5 by a forming tool T (shown schematically in FIGS. 5A and 5B by way of example), which can be similar to and have similar features and/or components as conventional forming tools such as are disclosed in U.S. Patent Application Publication No. 2005/0109653, the entire contents of which are incorporated herein by reference for all purposes. Also, the forming tool can have similar features and components such as the forming tool disclosed in International Publication No. WO 2008/049048, the entire contents of which are incorporated by reference for all purposes, or any other suitable forming tool assembly. Also, the blank 3 and the container 5 could be alternatively shaped (e.g., circular, oval, rectangular, irregular, etc.) without departing from the scope of this disclosure. The blank 3 of the present disclosure has features that help reduce, prevent, or eliminate delamination and/or buckling of a lamination material in an interior of the container 5 made from the blank at a bottom corner area 9 of the container.

The blank 3 can be formed from a laminate that includes more than one layer, but alternatively the laminate can be replaced with a single ply of material, such as, but not limited to, paperboard, cardboard, paper, or a polymeric sheet. In accordance with the exemplary embodiments of the present disclosure, the laminate can include a lamination layer 8, which can be a microwave interactive layer such as is common in MicroRite® containers available from Graphic Packaging International of Marietta, Ga. The lamination layer can be commonly referred to as, or can have as one of its components, a foil, a microwave shield, or any other term or component that refers to a layer of material suitable for shielding microwave energy and/or causing heating in a microwave oven. Alternatively, the lamination layer 8 can be any suitable material that is laminated onto a substrate. The lamination layer 8 comprises the inner/interior surface 12 of the blank 3 (FIGS. 1 and 1A). In the illustrated embodiment, the blank 3 has a substrate or base layer 14 forming an outer/exterior surface 16 (FIG. 1A) of the blank 3. The lamination layer 8 is supported by, and secured to (e.g., laminated on), the base layer 14, which can be in the form of paperboard, cardboard, polymer, or any other suitable material. Nonetheless and in accordance with the exemplary embodiments, the base layer 14 typically is an uncoated paperboard. The lamination layer 8 can be other suitable microwave interactive materials set forth below, or any other suitable material.

As shown in FIG. 1, the blank 3 has a longitudinal direction L1 and a lateral direction L2, wherein a longitudinal centerline CL of the blank 3 is generally parallel to the longitudinal direction L1, and a transverse centerline CT of the blank is generally parallel to the lateral direction L2. The blank 3 has a central portion 11, an outer edge 13, and a marginal portion 15 between the outer edge 13 and the central portion 11. As shown in FIG. 1, the bottom corner area 9 forms a transition area between the bottom portion 11 and the marginal portion 15. In addition, the blank 3 can include a first side region 21, a second side region 23, and two end regions 25.

In one embodiment, the marginal portion 15 of the blank 3 includes a plurality of score lines 19. The score lines 19 are all positioned in the marginal portion 15 in the end regions 25 such that the score lines extend generally radially from the outer edge 13 of the blank. In one embodiment, adjacent score lines 19 in respective curved regions 27 (e.g., where the outer edge 13 is generally curved) can be spaced apart by an angle A1 of at least approximately 5 degrees. Alternatively, the angle A1 could be any suitable angle. In respective straight portions 29 (e.g., where the outer edge 13 is generally straight), the score lines 19 are generally parallel. In one embodiment, the score lines 19 extend to the outer edge 13 of the blank 3, but the score lines could have a radially outer end point that is spaced in from the outer edge of the blank without departing from the disclosure. Also, in one embodiment, the score lines 19 are formed on the interior surface 12 such the score lines 19 comprise slight indentations in the interior surface 12 of the blank on the surface of the lamination layer 8 and slight protrusions on the exterior surface 16 of the blank on the outer surface of the base layer 14. The score lines 19 could be omitted or could be otherwise shaped, arranged, and/or configured without departing from the disclosure.

In the illustrated embodiment, a plurality of score lines 30 can be included in the bottom corner area 9 of the blank 3 for helping to reduce delamination of the lamination layer 8 from the base layer 14. The plurality of score lines 30 can include first side score lines 33 extending adjacent the first side region 21, second side score lines 35 extending adjacent the second side region 23, and end score lines 37 extending adjacent each of the end regions 25. In one embodiment, as schematically shown in FIG. 1B, the score lines 30 are formed on the interior surface 12 such that the score lines 30 comprise slight indentations, slots, or grooves in the interior surface 12 of the blank and slight protrusions on the exterior surface 16 of the blank. In the illustrated embodiment, the first side score lines 33 are generally straight and generally parallel to the longitudinal centerline CL, and the end score lines 37 are generally straight and generally parallel to the transverse centerline CT. As shown in FIG. 1, the second side score lines 35 are curved so that the respective ends of the individual score lines are farther from the longitudinal centerline CL and the first side region 21 than the respective midpoints of the score lines. The first and second side score lines 33, 35 can be generally centered on the transverse centerline CT, and the end score lines 37 can be generally centered on the longitudinal centerline CL. The score lines 30 could be omitted or could be otherwise shaped, arranged, and/or configured without departing from the disclosure.

In one example, the paperboard base layer 14 of the blank 3 can comprise 18 point paperboard having a thickness of approximately 0.018 inch (0.46 mm), and the lamination layer 8 can have a thickness of approximately 0.001 inch (0.025 mm) so that the blank 3 has a total thickness $T_b$ of approximately 0.019 inch (0.48 mm). The thickness of a foil within the lamination layer 8 can be approximately 0.000275 inch (0.007 mm), for example. In one embodiment, the thickness of the paperboard base layer 14 can be in the range of approximately 0.013 inch (0.33 mm) to approximately 0.030 inch (0.72 mm), the thickness of the lamination layer 8 can be in the range of approximately 0.0005 inch (0.013 mm) to approximately 0.0015 inch (0.038 mm), and the total thickness $T_b$ can be in the range of approximately 0.0135 inch (0.34 mm) to approximately 0.0315 inch (0.80 mm). Any of the above noted thicknesses or other dimensions noted above could be larger or smaller than noted or could be inside or outside the listed ranges without departing form the scope of the disclosure. All of the dimensional information presented herein is intended to be illustrative of certain aspects of the disclosure and is not intended to limit the scope of the disclosure, as various other embodiments of the disclosure could include dimensions that are greater than or less than the dimensions included herein.

Figure 2:
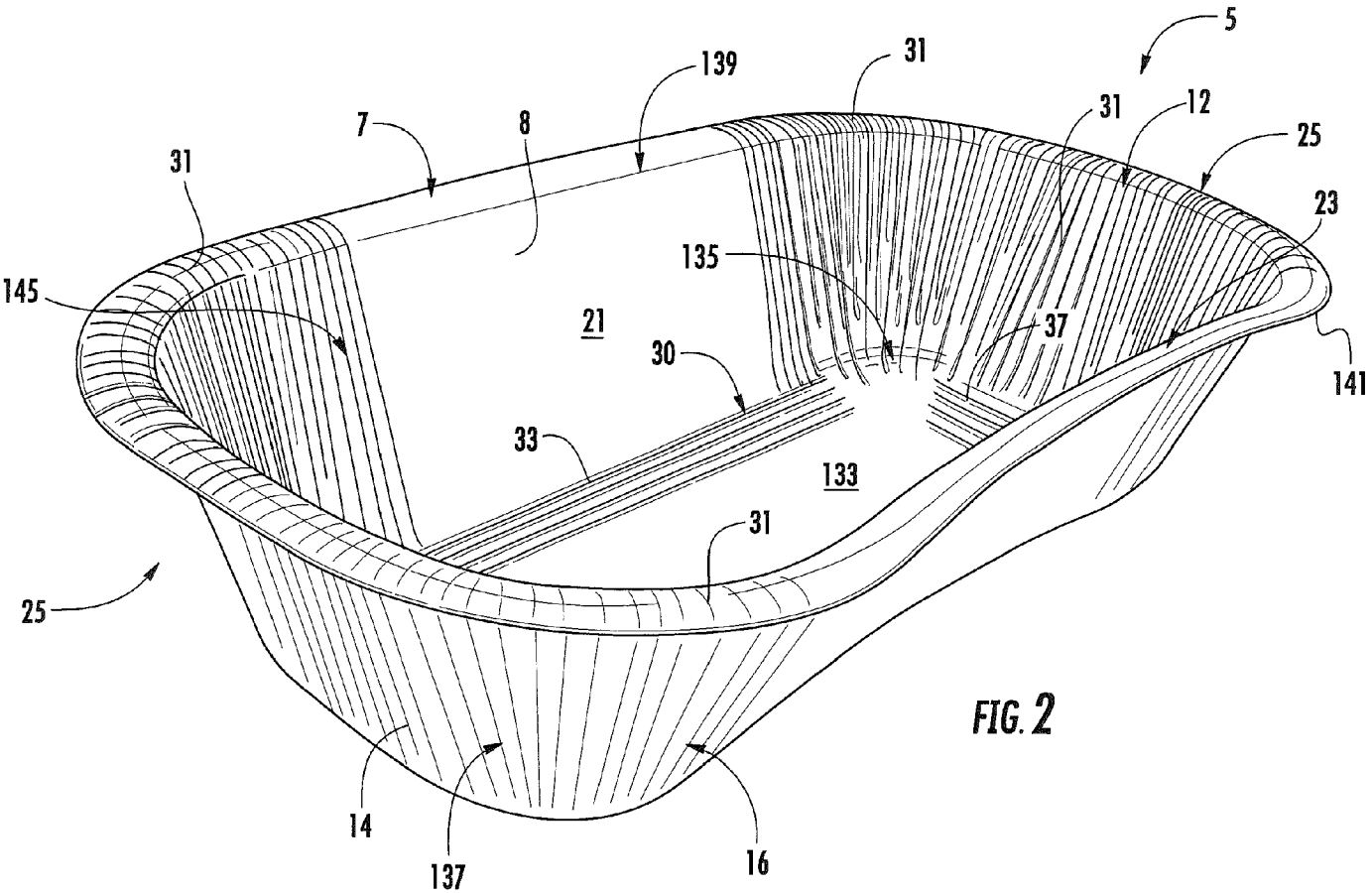
FIG. 2 is a perspective view of the container formed from the blank of FIG. 1 according to the first embodiment of the disclosure.
Figure 3:
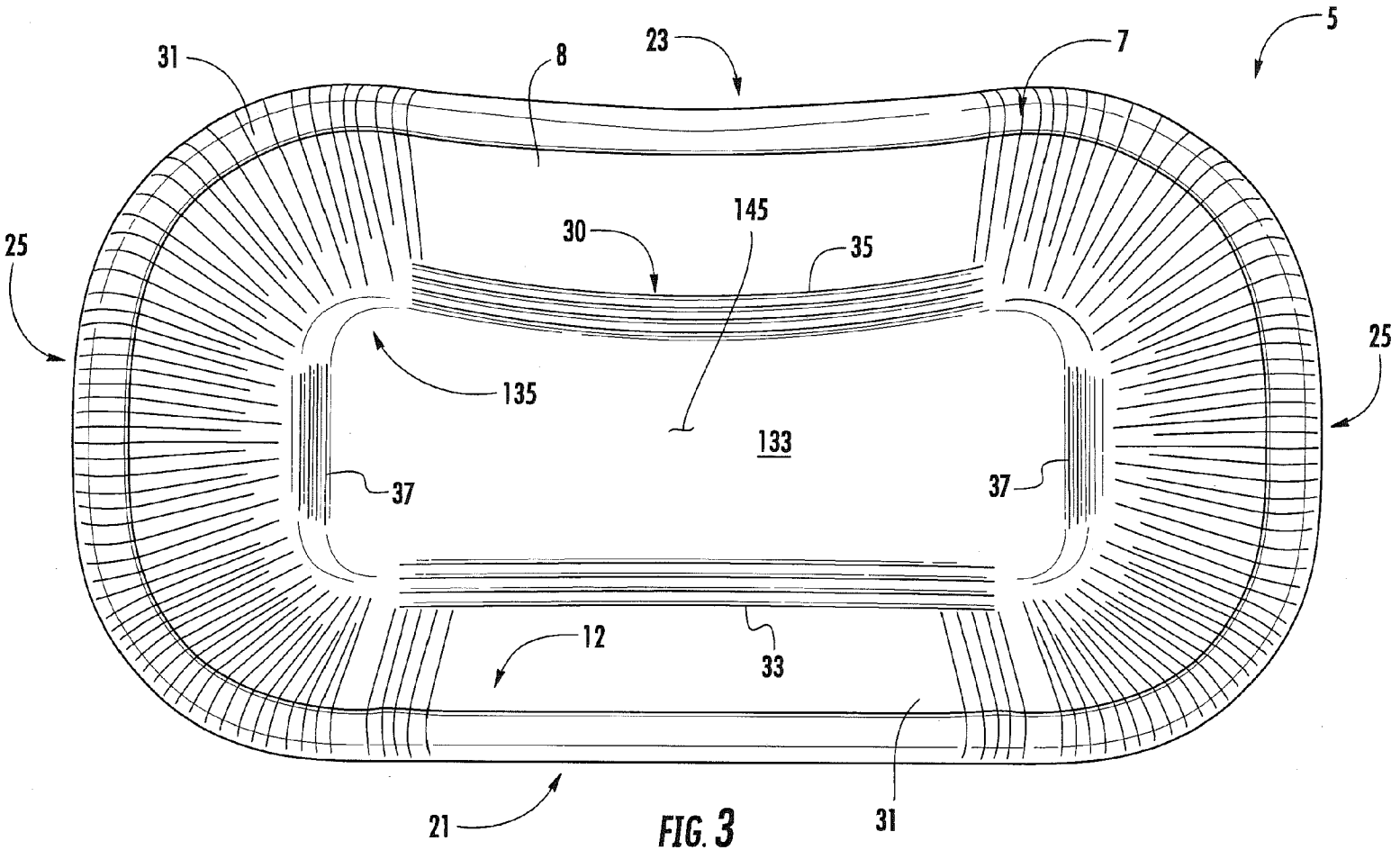
FIG. 3 is a perspective top view of the container of FIG. 2.
Figure 4:
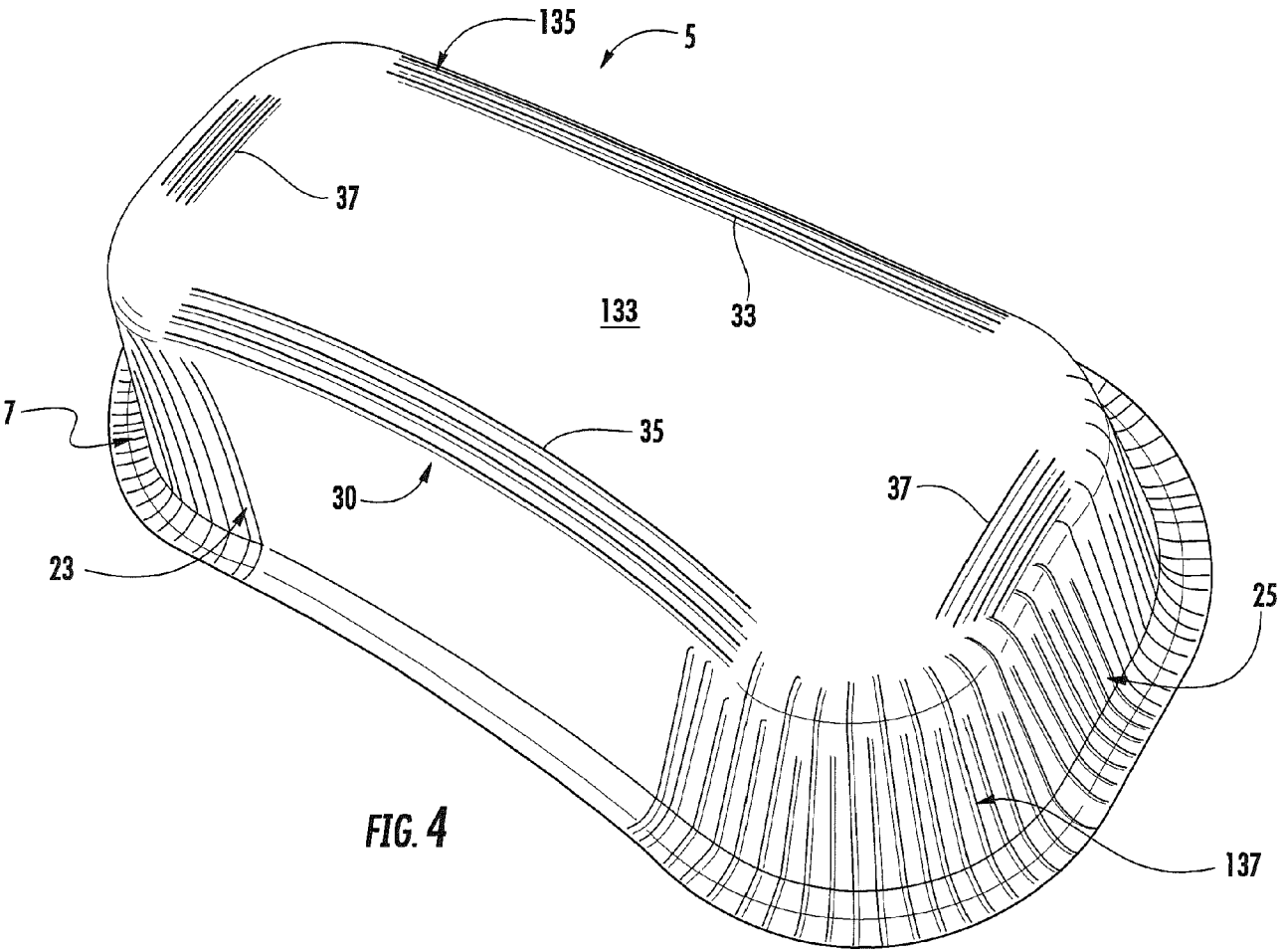
FIG. 4 is a perspective bottom view of the container of FIG. 2.

FIGS. 2-4 show one embodiment of the disclosure comprising a container 5 formed from the blank 3. The container 5 comprises a generally raised bottom wall 133, a bottom corner 135 that connects the bottom wall to a side wall 137, an upper corner 139 that connects the side wall 137 to the flange 7, and an outer edge 141. The bottom wall 133 generally is formed from the bottom portion 11 of the blank 3, the bottom corner 135 generally is formed from the bottom corner area 9 of the blank, and the side wall 137 and the flange 7 are formed from the marginal portion 15 of the blank. The outer radial edge 141 generally can correspond to the outer edge 13 of the blank 3. The bottom wall 133 and side wall 137 at least partially define an interior space or cavity 145 of the container 5. The lamination layer 8 is on the inner/interior surface 12 of the container 5 and the base layer 14 is on the outer/exterior surface 16 of the container. The container 5 is for holding and/or cooking and/or heating a food product (not shown) that is placed in the interior space 145 of the container.

As shown in FIGS. 2-4, the flange extends outward from the side wall 137, and an angled upper corner 139 of the flange 7 can be oblique with respect to the side wall 137 and the remainder of the flange 7. Alternatively, the upper corner 139 could be curved or otherwise formed or omitted. In the illustrated embodiment, the side wall 137 extends generally upwardly from the bottom corner 135 and the bottom wall 133, and the bottom corner 135 is curved so that the lowest portion of the container 5 is located along the curve of the bottom corner 135. Accordingly, when the container 5 is placed upright on a surface, a portion of the bottom corner 135 rests on the surface and the bottom wall 133 is spaced apart from the surface.

As shown in FIGS. 2 and 3, the side wall 137, the flange 7, and the bottom corner 135 include the first side region 21 in which the side wall 137 and the outer edge 141 are generally straight, the second side region 23 in which the side wall 137 and the outer edge 141 are curved toward the interior 145 of the container 5 (e.g., concave), and the end regions 25 in which the side wall 137 and the outer edge 141 form convex portions connected by a generally straight portion. The container 5 could have other shapes and/or dimensions without departing from the disclosure.

In the illustrated embodiment, when the blank 3 is formed into the container 5, the score lines 19 form overlapped portions or pleats 31. In the illustrated embodiment, the overlapped portions 31 are in the flange 7 of the container and the side wall 137, and extend down the side wall to a location adjacent the bottom wall 133. The overlapped portions 31 could be otherwise shaped, arranged, and/or configured without departing from the disclosure.

As shown in FIG. 3, the plurality of score lines 30 generally are disposed in the bottom corner 135 and can help prevent the lamination layer 8 from separating from the base layer 14 and extending into the interior 145 of the container 5. The first side score lines 33 are generally straight to correspond with the generally straight first side region 21 of the side wall 137, the second side score lines 35 are curved to correspond with the concave second side region 23 of the side wall, and the end score lines 37 are generally straight to correspond to the generally straight portions of the end regions 25 of the side wall. In an alternative embodiment, the end scores 37 could be curved with curved portions of the end regions.

In one embodiment, the lamination layer 8 can be generally more resistant to compression—especially compared to the paperboard base layer 14. Since the lamination layer 8 is interior to the base layer 14, the material of the lamination layer 8 can bunch up or buckle at the bottom corner 135 and separate from the base layer 14. For example, micro-layer interactions between the lamination layer and the base layer can cause an adhesive securing the layers together to fail where the adhesive is weaker and/or absent (e.g., due to uneven application). If the scores 30 are omitted, the material of the lamination layer 8 could separate from the base layer 14 and extend into the interior 145 of the container 5. The separated portions of the lamination layer could be damaged by an eating utensil, for example, and could be torn away from the interior surface 12 and mix with a food item contained in the container 5. While the materials used in the lamination layer 8 typically are generally inert, the damage to the interior surface of the container 5 can reduce the visual appeal of the container and food items (or other items) contained therein. Additionally, the loose pieces of lamination can cause concern and/or affect the enjoyment of a food item (or other item) in the container by a consumer.

The scores 30 can help to prevent the lamination layer 8 from buckling into the interior 145. As shown schematically in FIG. 1B, the scores 30 generally form grooves in the interior surface 12 of the container so that the lamination layer 8 is stretched somewhat in the bottom corner 135. Accordingly, the lamination layer is compressed into the grooves of the scores 30 when the blank is pressed into the container, and the lamination layer is less likely to delaminate from the base layer 14. What portions of the lamination layer may separate from the base layer will still be disposed within the grooves of the scores 30, and therefore will be compressed into the curve of the bottom corner and at least partially protected from eating utensils, for example, by the grooves. Accordingly, any delaminated portions of the lamination layer 8 will be less likely to be torn away from the container and mix with a food item (or other item) in the container. Accordingly, the delamination of the lamination layer 8 is reduced and controlled to help maintain the visual appeal and safety of the container and the food or other items contained in the container.

Figure 5A:
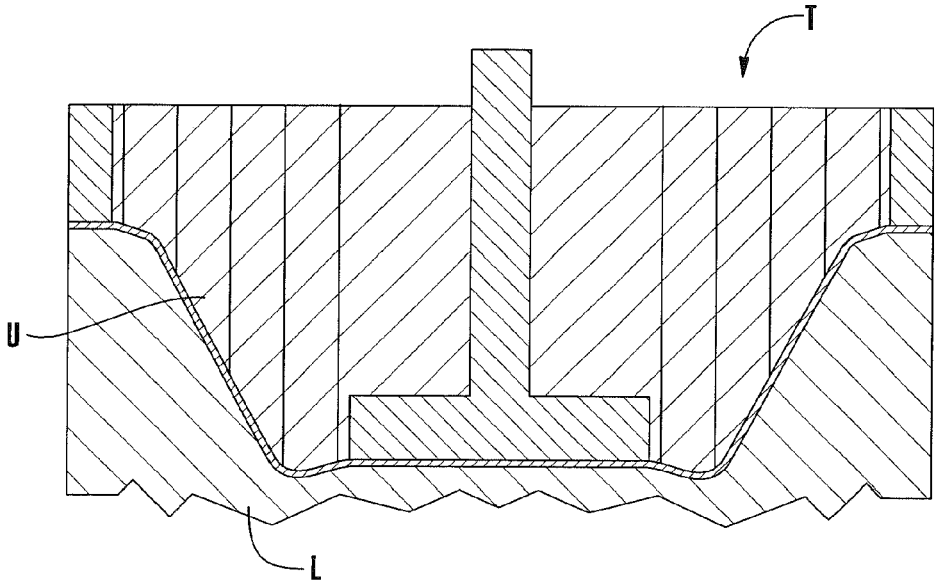
FIGS. 5A and 5B are schematic views of an exemplary forming tool for forming a container according to an exemplary embodiment.
Figure 5B:
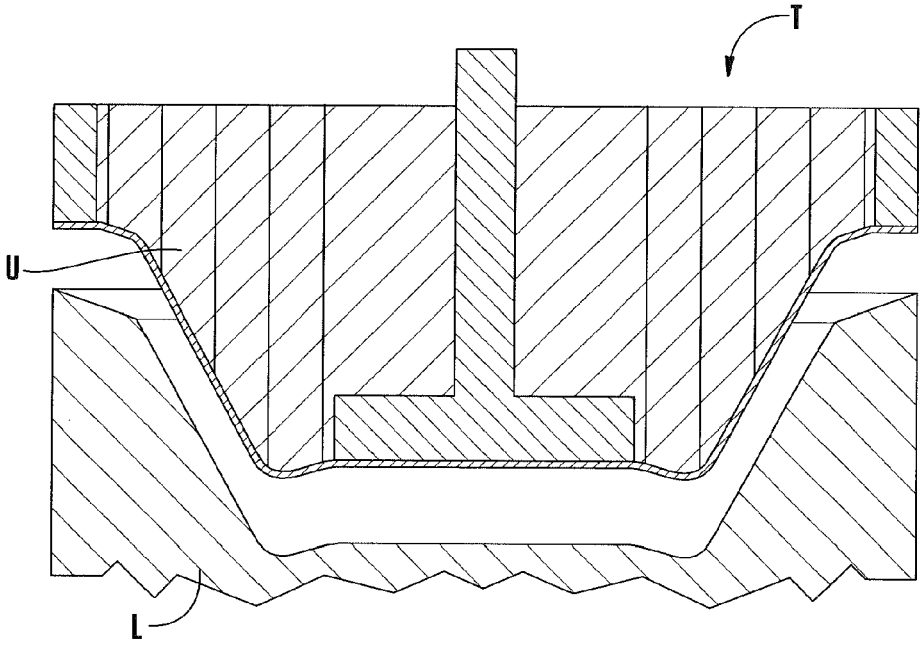

In one embodiment, the blank 3 is formed into the container by conveying a blank and placing the blank in the forming tool T (schematically shown in FIGS. 5A and 5B by way of example) with a lower tool assembly L and upper tool assembly U in a separated or open position. The forming tool T is used to press form the blank 3 into the container 5 by moving the tool assemblies L, U together, to a closed position (FIG. 5A, for example). After press-forming the container 5, the tool assemblies L, U can be separated (FIG. 5B, for example) to release the container 5. When the flat blank 3 is pressed in the forming tool T, the substrate 14 and lamination layer 8 are compressed and formed into the three-dimensional container 5. The score lines 19 facilitate forming the flat blank into the three-dimensional container in the forming tool, and the score lines 30 help prevent or reduce buckling of the lamination layer. The score lines 19 allow formation of the marginal portion 15 of the blank 3 into the side wall 137 and flange 7 of the container 5. The container 5 could be otherwise formed and/or could be formed by any suitable forming tool or forming tools without departing from the disclosure. The forming tool T shown schematically in FIGS. 5A and 5B is included by way of example only.

Figure 6:
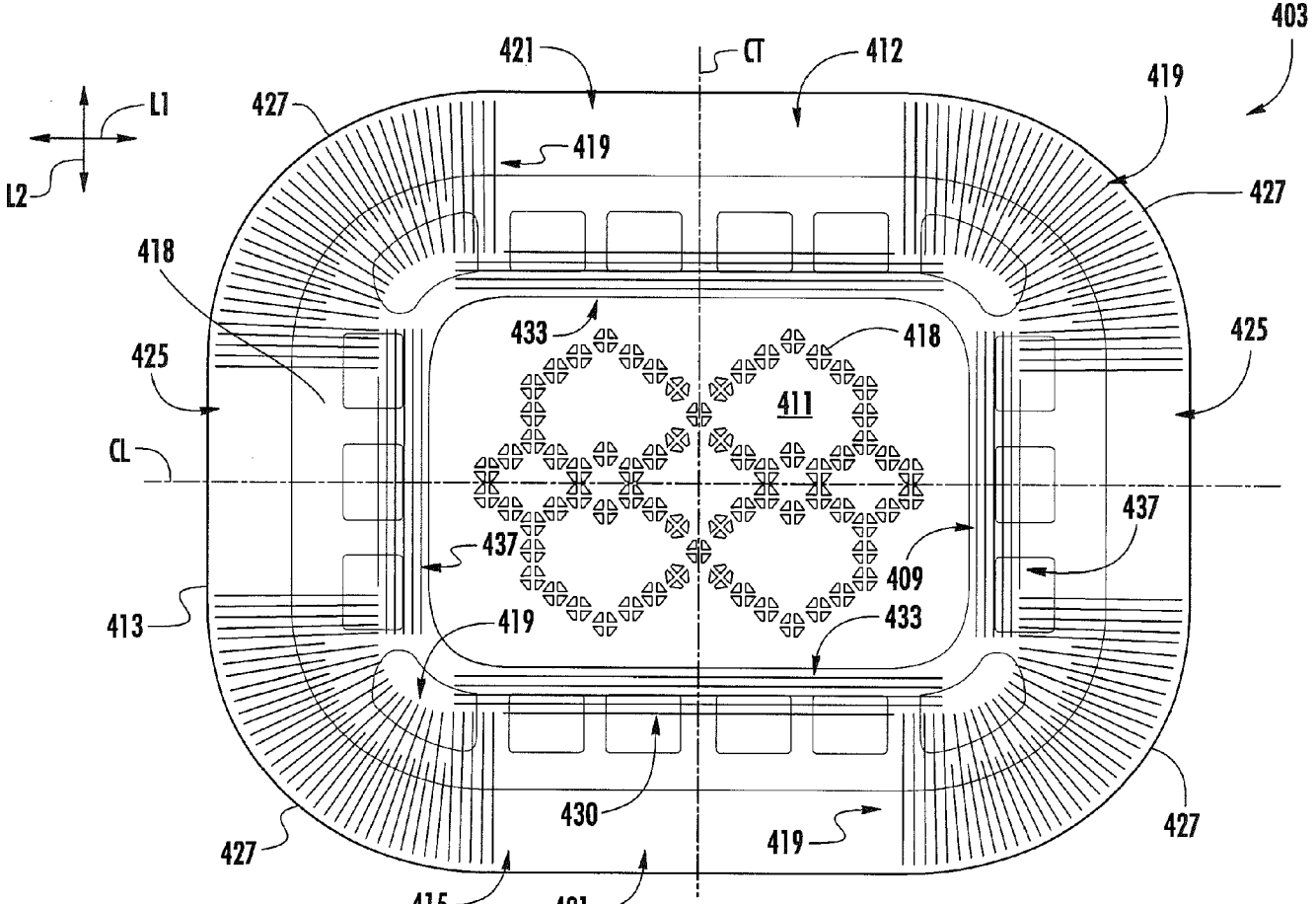
FIG. 6 is a plan view of a blank used for forming a container according to a second embodiment of the disclosure.
Figure 7:
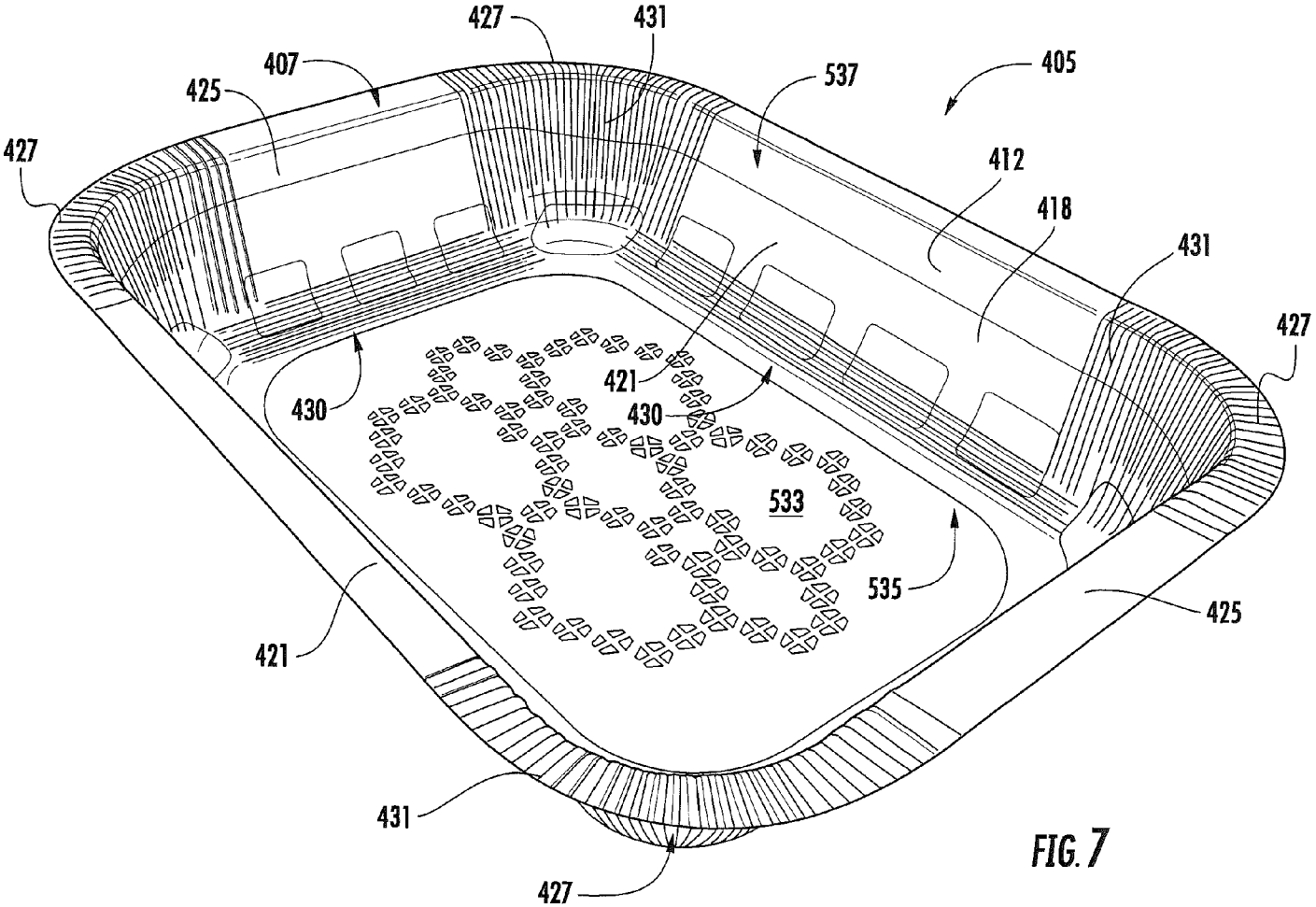
FIG. 7 is a perspective view of the container formed from the blank of FIG. 6 according to the second embodiment of the disclosure.
Figure 8:
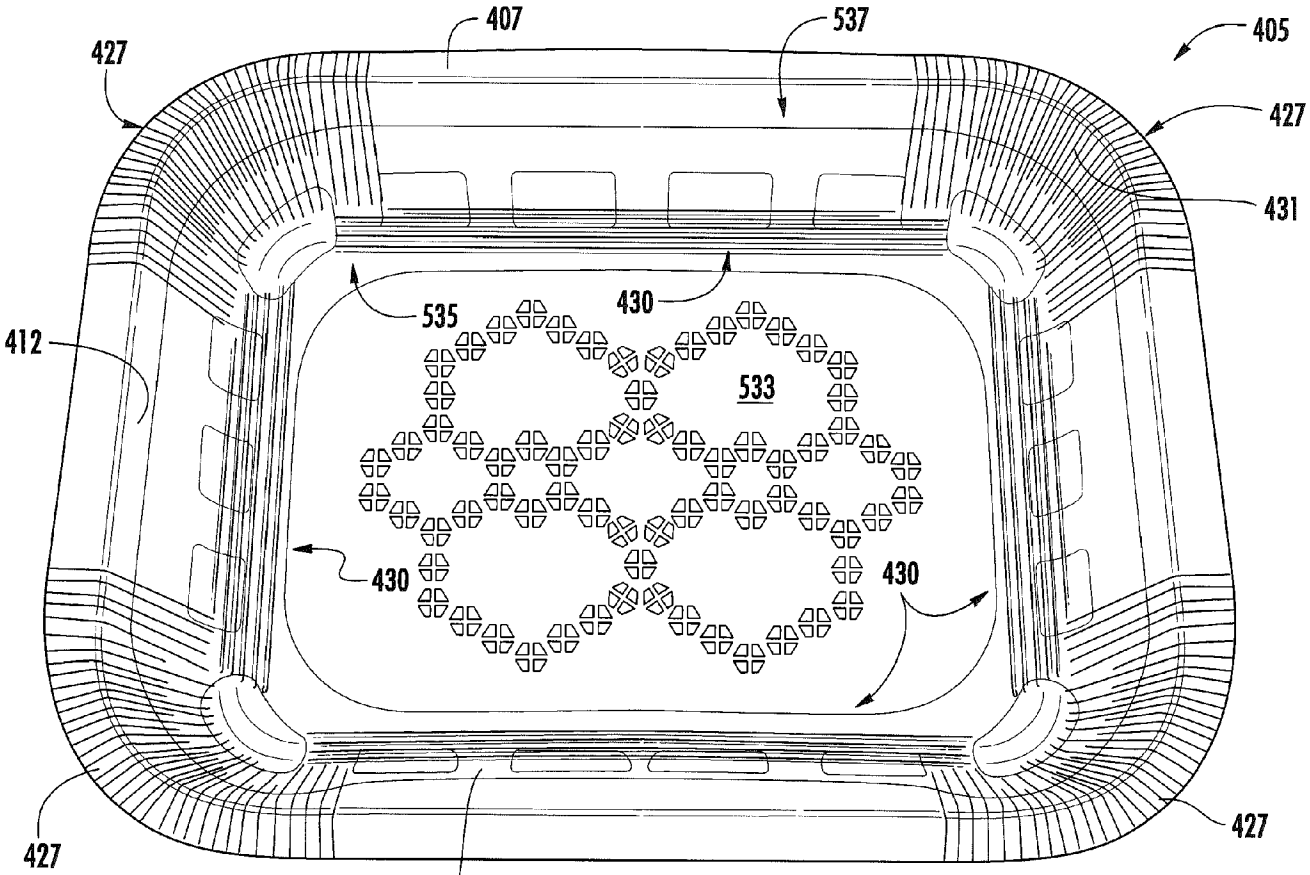
FIG. 8 is a perspective top view of the container of FIG. 7.
Figure 9:
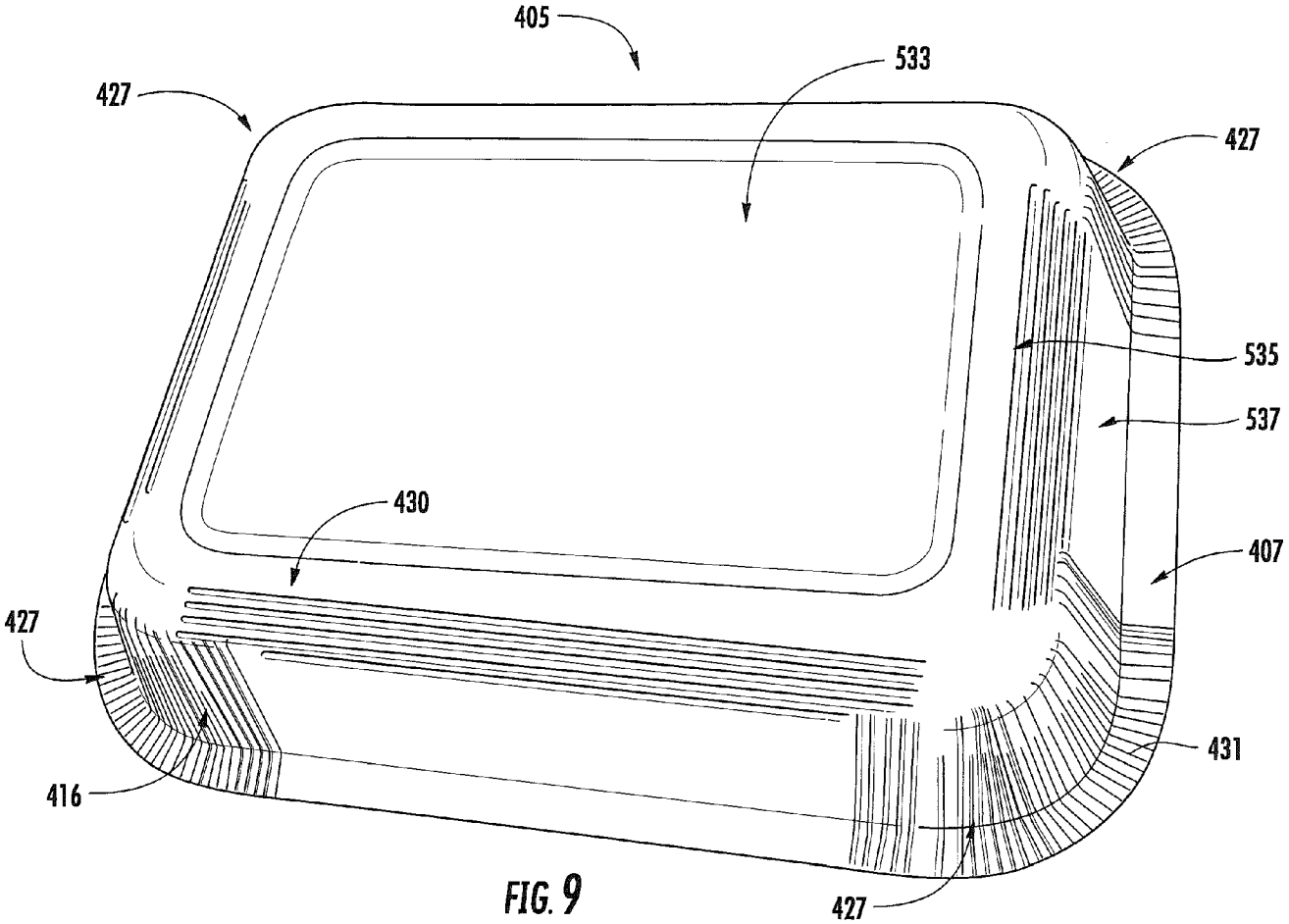
FIG. 9 is a perspective bottom view of the container of FIG. 7.

FIG. 6 is a view of an interior surface 412 of a blank 403 for forming a container 405 (FIGS. 7-9) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the blank 403 is generally rectangular with two side regions 421 and two end regions 425. The blank 403 has a central portion 411, an outer edge 413, a marginal portion 415, and a bottom corner area 409. A plurality of score lines 419 are positioned in the marginal portion 415 in respective curved corners 427 for forming pleats 431 (FIG. 7). A plurality of score lines 430 in the corner area 409 can be generally similar to the score lines 30 of the previous embodiment. The score lines 430 include generally straight side score lines 433 and end score lines 437. As shown in FIG. 6, the foil of the lamination layer 408 is disposed in a particular pattern 418. Alternatively, the foil can be distributed in any suitable pattern in the lamination layer, could be evenly distributed in the lamination layer, or could be omitted. As shown in FIGS. 7-9, the container 405 includes a generally raised bottom wall 533, a bottom corner 535 with the plurality of scores 430, a side wall 537, and a flange 407. The container 405 also includes generally straight side regions 421, generally straight end regions 425, and curved corners 438. The blank 403 and/or the container 405 could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

Further, the containers 5, 405 may cooperate with a lid (not shown) for holding, heating, and/or cooking a food product or other item that is held in the container without departing from the disclosure.

Any of the blanks, containers, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A container for holding an article, the container comprising:

a lamination layer at least partially secured to a base layer;

a bottom wall and a side wall cooperating to at least partially define a cavity of the container with the lamination layer at least partially comprising an interior surface of the container adjacent the cavity, the side wall comprises an end region, at least a portion of the end region is curved, and a plurality of pleats are formed in at least the end region of the side wall; a plurality of score lines extending in the container for at least partially reducing buckling of the lamination layer into the cavity of the container, the plurality of score lines extending transversely with respect to at least one of the plurality of pleats in the end region, and a bottom corner connecting the bottom wall and the side wall, wherein the plurality of score lines extend in at least the bottom corner.

2. The container of claim 1, wherein the score lines of the plurality of score lines at least partially define respective grooves in the interior surface of the container.

3. The container of claim 2, wherein the score lines of the plurality of score lines at least partially define respective protrusions in an exterior surface of the container.

4. The container of claim 2, wherein the bottom corner is curved and is convex from an exterior surface of the container so that the lamination layer generally has a smaller radius of curvature than the base layer.

5. The container of claim 2, wherein the side wall comprises a side region, and the plurality of score lines comprises a first plurality of score lines extending in the bottom corner adjacent the side region of the side wall and a second plurality of score lines extending in the bottom corner adjacent the end region of the side wall, the first plurality of score lines extends transversely with respect to at least one of the plurality of pleats in the side region, and the second plurality of score lines extends transversely with respect to at least one of the plurality of pleats in the end region.

6. The container of claim 5, wherein the side region of the side wall is curved and is concave from an exterior surface of the container, and the score lines of the first plurality of score lines are curved.

7. The container of claim 1, wherein the side wall comprises a first side region and a second side region, and the plurality of score lines comprises a first plurality of score lines extending in the bottom corner adjacent the first side region of the side wall, a second plurality of score lines extending in the bottom corner adjacent the second side region of the side wall, and a third plurality of score lines extending in the bottom corner adjacent the end region of the side wall, the first plurality of score lines extends transversely with respect to at least one of the plurality of pleats in the first side region, the second plurality of score lines extends transversely with respect to at least one of the plurality of pleats in the second side region, and the third plurality of score lines extends transversely with respect to at least one of the plurality of pleats in the end region.

8. The container of claim 7, wherein the second side region of the side wall is curved and is concave from an exterior surface of the container, and the score lines of the second plurality of score lines are curved.

9. The container of claim 8, wherein an endpoint of each score line of the second plurality of score lines is farther from the first side region of the side wall than a midpoint of the respective score lines of the second plurality of score lines.

10. The container of claim 8, wherein the first side region of the side wall is generally straight, and the score lines of the first plurality of score lines are generally straight.

11. The container of claim 7, wherein the end region extends between the first side region and the second side region.

12. The container of claim 11, wherein at least a portion of the end region of the side wall is curved.

13. The container of claim 1, wherein the side wall extends generally upwardly from the bottom corner and a flange extends generally outwardly from the side wall.

14. The container of claim 1, wherein the bottom corner is curved so that the lamination layer generally has a smaller radius of curvature than the base layer in at least the bottom corner.

15. The container of claim 1, wherein at least a portion of the bottom wall is raised above at least a portion of the bottom corner.

16. A blank for forming a container for holding an article, the blank comprising a lamination layer at least partially secured to a base layer;

a bottom portion and a marginal portion for cooperating to at least partially define a cavity of the container formed from the blank, wherein the lamination layer is for at least partially forming an interior surface of the container formed from the blank; and a plurality of score lines extending in the blank for at least partially reducing buckling of the lamination layer into the cavity of the container formed from the blank;

a bottom corner area connecting the bottom portion and the marginal portion, wherein the plurality of score lines extend in at least the bottom corner area; and a plurality of pleat scores in an end region of the marginal portion, the plurality of score lines extending transversely with respect to at least one of the plurality of pleat scores in the end region, and wherein the marginal portion is for at least partially forming at least a side wall in the container formed from the blank, and the pleat scores of the plurality of pleat scores are for forming respective pleats in the side wall of the container formed from the blank.

17. The blank of claim 16, wherein the score lines of the plurality of score lines at least partially define respective grooves in the interior surface of the blank.

18. The blank of claim 17, wherein the score lines of the plurality of score lines at least partially define respective protrusions in an exterior surface of the blank.

19. The blank of claim 17, wherein the bottom corner area is for forming a curved bottom corner when the container is formed from the blank, and the bottom corner is for being convex from an exterior surface of the container formed from the blank so that the lamination layer generally has a smaller radius of curvature than the base layer in the bottom corner when the container is formed from the blank.

20. The blank of claim 17, wherein the marginal portion comprises a side region, and the plurality of score lines comprises a first plurality of score lines extending in the bottom corner area adjacent the side region of the marginal portion and a second plurality of score lines extending in the bottom corner area adjacent the end region of the marginal portion, the first plurality of score lines extends transversely with respect to at least one of the plurality of pleats in the side region, and the second plurality of score lines extends transversely with respect to at least one of the plurality of pleats in the end region.

21. The blank of claim 20, wherein the score lines of the first plurality of score lines are curved, and the side region of the marginal portion being for forming a curved portion of the side wall when the container is formed from the blank, the curved portion of the side wall being concave from an exterior surface of the container formed from the blank.

22. The blank of claim 16, wherein the marginal portion comprises a first side region and a second side region, and the plurality of score lines comprises a first plurality of score lines extending in the bottom corner area adjacent the first side region of the marginal portion, a second plurality of score lines extending in the bottom corner area adjacent the second side region of the marginal portion, and a third plurality of score lines extending in the bottom corner area adjacent the end region of the marginal portion, the first plurality of score lines extends transversely with respect to at least one of the plurality of pleats in the first side region, the second plurality of score lines extends transversely with respect to at least one of the plurality of pleats in the second side region, and the third plurality of score lines extends transversely with respect to at least one of the plurality of pleats in the end region.

23. The blank of claim 22, wherein the score lines of the second plurality of score lines are curved, and the second side region of the marginal portion is for forming a curved portion of the side wall when the container is formed from the blank, the curved portion of the side wall being concave from an exterior surface of the container formed from the blank.

24. The blank of claim 23, wherein an endpoint of each score line of the second plurality of score lines is farther from the first side region of the marginal portion than a midpoint of the respective score lines of the second plurality of score lines.

25. The blank of claim 23, wherein and the score lines of the first plurality of score lines are generally straight, and the first side region of the marginal portion is for forming a generally straight portion of the side wall when the container is formed from the blank.

26. The blank of claim 23, wherein the end region extends between the first side region and the second side region.

27. The blank of claim 16, wherein the marginal portion of the blank is for at least partially forming a side wall and a flange when the container is formed from the blank.

28. A method of forming a container, comprising:

obtaining a blank comprising a lamination layer at least partially secured to a base layer, a plurality of score lines, a bottom portion and a marginal portion, a bottom corner area connects the bottom portion and the marginal portion and a plurality of pleat scores in an end region of the marginal portion, the plurality of score lines extending transversely with respect to at least one of the plurality of pleat scores in the end region; and forming the container comprising a bottom wall and a side wall from the blank, wherein the Ruining the container comprises forming a cavity at least partially defined by the bottom wall and the side wall, forming at least the side wall from the marginal portion of the blank, forming the bottom wall from the bottom portion of the blank, forming a bottom corner from the bottom corner area of the blank, forming a side region of the side wall, and the lamination layer comprising an interior surface of the container adjacent the cavity;

wherein, during the forming the container, the plurality of score lines at least partially reduces buckling of the lamination layer into the cavity of the container and the side region is curved and is concave from an exterior surface of the container.

29. The method of claim 28, wherein the bottom corner is curved and is convex from an exterior surface of the container so that the lamination layer generally has a smaller radius of curvature than the base layer, and the plurality of score lines extend in at least the bottom corner.

30. The container of claim 1, wherein the score lines extends across the longitudinal centerline of the container and extend transverse to the longitudinal centerline, and the at least one of the plurality of pleats in the end region extends parallel to the longitudinal centerline.

31. The container of claim 5, wherein the first plurality of score lines extend across a transverse centerline of the container and extend transverse to the transverse centerline and the at least one of the plurality of pleats in the side region extends parallel to the transverse centerline, the second plurality of score lines extend across the longitudinal centerline of the container and extend transverse to the longitudinal centerline and the at least one of the plurality of pleats in the end region extends parallel to the longitudinal centerline.

* * * * *